United States Patent [19]

van Assendelft

[11] 4,022,009

[45] May 10, 1977

[54] METALLIC CABLE

[75] Inventor: Leendert van Assendelft, Arnhem, Netherlands

[73] Assignee: Akzo N.V., Arnhem, Netherlands

[22] Filed: May 3, 1976

[21] Appl. No.: 682,264

[30] Foreign Application Priority Data

May 12, 1975 Netherlands ..... 7505523
May 12, 1975 Netherlands ..... 7505524

[52] U.S. Cl. ..... 57/145; 152/359; 428/592

[51] Int. Cl.[2] ..... D02G 3/12; D02G 3/48

[58] Field of Search ..... 57/144, 148, 161, 166; 29/191.6, 193; 152/356, 359

[56] References Cited

UNITED STATES PATENTS

| | | | |
|---|---|---|---|
| 2,598,033 | 5/1952 | Bourdon | 57/144 |
| 2,998,694 | 9/1961 | Payer | 57/145 |
| 3,273,978 | 9/1966 | Paul | 57/144 X |
| 3,274,846 | 9/1966 | Forster | 57/145 X |
| 3,540,512 | 11/1970 | Heimonics, Jr. et al. | 152/356 X |
| 3,677,318 | 7/1972 | Glass et al. | 152/359 X |

*Primary Examiner*—Jerry W. Myracle
*Assistant Examiner*—Charles Gorenstein
*Attorney, Agent, or Firm*—Stevens, Davis, Miller & Mosher

[57] ABSTRACT

A metallic cable adapted to be used to advantage for reinforcing various types of elastomeric articles such as belts and motor vehicle tires has a core formed from two or more metallic filaments wound together into a helical shape without twisting one filament about the other whereby each core filament lies in line contact with at least one other core filament, the line of contact being parallel to the direction of the filament and a helically wound wrapping filament is disposed about the core filaments. The wrapping filament is helically wound at the same lay and hand as the core filaments and is positioned on the inside of the helix formed by the core filaments.

5 Claims, 1 Drawing Figure

FIG. 1
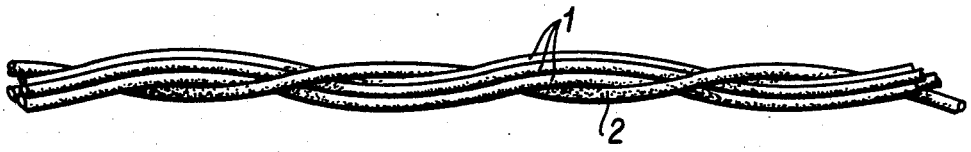
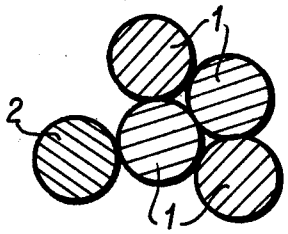
FIG. 2

METALLIC CABLE

This invention relates generally to cables and more particularly to a cable for reinforcing elastomeric articles comprising helically formed filaments and one or more single steel wrapping filaments wound on two or more single steel core filaments that are not wound about one another.

The use of reinforcing cables of the type indicated above for reinforcing articles of elastomeric material, such as vehicle tires, conveyor belts, hose and the like, is known from U.S. Pat. No. 3,273,978. The reinforcing element described in this patent is formed by a number of helically formed juxtaposed core filaments disposed in out-of-phase relationship on which one or more wrapping filaments are wound. As the juxtaposed core wires are disposed in out-of-phase relationship, they are only in point-to-point contact with each other along their length and the cable thus formed will therefore have a substantially open structure. The object of such a structure is to provide sufficient spacing for penetration by the elastomeric material, as a result of which the cable embedded in the elastomer has improved longitudinal elasticity over that of conventional metallic cables. With the cables described in the aforementioned U.S. patent, the wrapping filaments serve only the function to keep the randomly disposed core filaments together. Consequently, when the cable is loaded longitudinally, the wrapping filaments contribute considerably less to the strength of the cable than do the core filaments. Moreover, because the core filaments are spaced widely apart, the outside diameter of the disclosed cable is relatively large, so that the number of reinforcing filaments that can be accommodated in the space available in the article to be reinforced is relatively small, which in its turn has the disadvantage that it is not possible to obtain an optimum reinforcing effect. It is also apparent that for some applications the elasticity of the cables is too high and the modulus of elasticity is undesirably low under low loads. This drawback is encountered particularly if such cords are used for the belts below the tread of an automobile tire.

It is an object of the present invention to provide a reinforcing cable of the type indicated above for elastomeric articles in which the wrapping filaments fully contribute to the strength of the cable and the cable has a high modulus of elasticity which in cooperation with the elastomeric material in which it is embedded will produce a great stiffening and reinforcing effect in the elastomeric article.

Other objects of the invention will become apparent from the following description with reference to the accompanying drawing wherein FIG. 1 is a side elevation of a length of one embodiment of the cable provided by the invention; and FIG. 2 is a cross-section of the embodiment of FIG. 1.

The foregoing objects and others are accomplished in accordance with this invention generally speaking, by providing a reinforcing cable of the type indicated above wherein the core filaments are of substantially identical helical shape and are so positioned beside and against each other that each core filament is in line contact with at least one other core filament, the line of contact being parallel to the direction of the filament, and the wrapping filaments are in the form of a helix having substantially the same hand and the same pitch as the core filaments and are positioned on the inside of the helix formed by the core filaments. The filaments may be metal such as, for example, steel wires used to make radial steel tires.

The heretofore available steel cords used for reinforcing tires and other elastomeric articles have had core filaments which are wound about each other. The cable provided by the invention differs from the prior art cable in that the helical core filaments are not wound about one another but extend along and against each other in such a way that each core filament is in contact with one or more other core filaments all along the length thereof. The cable according to the invention is of a simple construction and is found to have a particularly favorable combination of static and dynamic properties such as strength, longitudinal elasticity, tensile modulus, force distribution in the filaments, compressionfatigue resistance and processability.

In the cable provided by the invention, the wrapping filaments form a helix whose pitch is the same as that of the core filaments. The wrapping filaments are disposed about the core filaments in such a way that in any cross-section of the cable, the wrapping filaments lie against the inside of the helix formed by the core filaments. The angle of inclination of the wrapping filaments is of the same order of magnitude as that of the core filaments. As a result, the wrapping filaments and the core filaments contribute to the strength of the cable to a similar degree. The core may be used to particular advantage in reinforcing belts of automobile tires. It should be added that it is known to make use for this purpose of steel cords, more particularly single stranded steel cords. The belt is generally built up of two closely spaced parallel cord plies, the cords of the one ply crossing those of the other ply. It has now been found that a belt reinforced with cords according to the invention has a considerably higher modulus than a belt reinforced with an equally large number of single stranded cords of equal length of lay and made up of filaments of equal diameter. The higher modulus results in the tire provided with such a belt displaying improved riding qualities, and more particularly in improved cornering behavior.

A more rigid and, hence, less deformable belt contributes to the motor car's cornering ability, to direct steering and consequently to reduced tread wear. On the other hand, it is also possible for the tire belt to be made of fewer cords such that the modulus of the belt is equal to that in the case of reinforcement with the known stranded cords. The use of the cords according to the invention then has the advantage of lending to a lighter construction, which will again be beneficial to riding comfort.

The cords according to the invention, moreover, have a good resistance to corrosion and the spreading of corrosion. It has been found that during processing the elastomeric material readily penetrates between the adjoining bundle filaments of the cord and also into the space formed within the bundle filaments. This is not the case with single stranded cords, where the component filaments are in such firm contact with each other that the elastomer cannot penetrate into the central cavity within the component filaments, which will lead to the filaments under some circumstances being subject internally to corrosion, which is rapidly found to spread through the central cavity. This is attended with a considerable deterioration of the adhesion of rubber to cord and of the fatigue resistance of the cord. The cords according to the invention do not show this disadvantage. The filaments and in particular the bundle filaments covered with some elastomeric material contribute to the resistance of the filaments to wear under bending loads. Moreover, the cable also adheres well to the elastomeric material.

An effective embodiment of the reinforcing cable with one wrapping filament is obtained if the wrapping filament is shifted half a pitch length relative to the pitch of the core filaments. In this construction the crest of the lay of the wrapping filament is always halfway between two successive crests of the lay of the core filaments.

A preferred embodiment of the reinforcing cable is provided with one wrapping filament and is characterized in that it comprises 3 to 8 core filaments and the core filaments and the wrapping filament have the same diameter, which is in the range of about 0.15 to about 0.5 mm, and the lay length is 25 to 100 times the wire diameter.

The cables according to the invention can be made by imparting a permanent helical deformation to the core filaments or assembling the core filaments after they have been helically shaped and subsequently winding the bundle with one or more wrapping filaments which also have previously been made to undergo a permanent helical deformation by the method and with the apparatus disclosed in my Netherlands Pat. Application No. 7,505,524 and the corresponding United States patent application, Attorney's Docket No. CWU 13061 being filed simultaneously herewith. The pre-formation of the wrapping filaments may with advantage be such that they exert an elastic pressure on the core filaments. The wrapping filaments are in point-to-point contact with the core filaments. If the wrapping filaments are very tightly packed on the core filaments, then at the points of contact the curvature of the wrapping filament may be somewhat sharper than that of the theoretical helix. It will be clear that such reinforcing cables fall within the scope of the invention.

EXAMPLE

The superiority of an elastomeric strip reinforced with the cable provided by this invention over a similar strip reinforced with a conventional cable is illustrated by the following tests. Use is made of test strips of reinforced rubber containing two cord (steel cable) plies. Test strips are prepared with one strip reinforced with cords A and the other with cords B. The cord plies in the strip are separated by a 1 mm thick layer of rubber and covered on either side with a 1.5 mm thick layer of rubber. The strips are cured in a mold measuring 100 by 12 cm for 30 minutes at 150° C. After they have been cured, the strips are cut into test specimens 10 cm wide. For each ply, the end of the cords is 20 per inch (e p i ) and the cords in a ply are at an angle of 16° and 22°, respectively, with the longitudinal axis of the strip. The modulus of each reinforced strip is determined on an Instron dynamometer, using a gauge length of 72.6 cm and a clamp speed of 2 cm/min. The strips contain steel cords made up of filaments 0.25 in diameter.

The cords A according to the invention consist of four filaments which form a bundle on which one wrapping filament is laid. The lay length is 10 mm. The wrapping filament is shifted half a lay length relative to lay of the bundle filaments.

The cords B are of the known construction of five filaments that are twisted together about each other; lay length 9.5 mm.

The modulus values found are listed in the following table:

,1/22 Modulus expressed in kN at 1% elongation

| | | Strips with cords: | | | |
|---|---|---|---|---|---|
| | | A | | B | |
| Cord angle with longitudinal direction of the strip | ° | 22 | 16 | 22 | 16 |
| Modulus | kN | 3.0 | 10.4 | 2.8 | 9.2 |

The disposition of the filaments in the cable is elucidated with reference to the accompanying drawing.

One embodiment of a cable having four core filaments and one wrapping filament provided by the invention is illustrated in FIGS. 1 and 2. The core filaments are grouped in a diamond shaped pattern but they also may be arranged to form a square.

The core filaments 1 are wound with an equally thick wrapping filament 2, which is positioned on the common inside of the helix formed by the core filaments and in such a way that the wrapping filament is shifted half a phase relative to the core filaments.

Although the invention has been described in detail for the purpose of illustration, it is to be understood that such detail is provided solely for that purpose and that variations can be made therein by those skilled in the art without departing from the spirit and scope of the invention.

I claim:

1. A reinforcing cable for elastomeric articles comprising helically formed filaments, one or more single metal wrapping filaments wound on two or more single metal core filaments that are not wound about one another, characterized in that the core filaments are of substantially identical helical shape and are positioned beside and against each other whereby each core filament is in line contact with at least one other core filament, the line of contact being parallel to the direction of the filament, and the wrapping filaments are in the form of a helix having the same hand and the same pitch as the core filaments and are positioned on the inside of the helix formed by the core filaments.

2. A reinforcing cable according to claim 1, provided with one wrapping filament, characterized in that the wrapping filament is shifted half a pitch length relative to the pitch of the core filaments.

3. A reinforcing cable according to claim 2, characterized in that it contains 3 to 8 core filaments, and the core filaments and the wrapping filaments have the same diameter, which is in the range of 0.15 to 0.50 mm, and the pitch is 25 to 100 times the wire diameter.

4. Elastomeric articles provided with a reinforcing cable according to claim 1.

5. A vehicle tire provided with a reinforcing belt built up of the reinforcing cable of claim 1.

* * * * *